US005347774A

United States Patent [19]

Smith

[11] Patent Number: 5,347,774

[45] Date of Patent: Sep. 20, 1994

[54] METHODS OF MANUFACTURING CURVED STAIRCASES AND STAIRCASES PRODUCED

[75] Inventor: Lynn H. Smith, Gunter, Tex.

[73] Assignee: L. J. Smith, Bowerston, Ohio

[21] Appl. No.: 977,268

[22] Filed: Nov. 16, 1992

Related U.S. Application Data

[60] Division of Ser. No. 800,064, Nov. 27, 1991, Pat. No. 5,163,491, which is a continuation-in-part of Ser. No. 468,758, Jan. 23, 1990, abandoned.

[51] Int. Cl.[5] ..... E04F 11/00

[52] U.S. Cl. ..... 52/182; 52/191; 144/354

[58] Field of Search ..... 52/182, 187, 191; 144/329, 347, 349, 353, 354, 345; 29/464, 466, 467

[56] References Cited

U.S. PATENT DOCUMENTS

| | | | |
|---|---|---|---|
| 485,449 | 11/1892 | Borneman et al. . | |
| 2,760,239 | 8/1956 | Riley | 52/191 X |
| 3,473,275 | 10/1969 | Lappin, Jr. | 52/187 |
| 3,616,585 | 11/1971 | Cirgenski et al. | 52/187 |
| 3,664,011 | 5/1972 | Labastrov | 29/526 |
| 3,727,360 | 4/1973 | Ollman | 52/187 |
| 3,768,016 | 10/1973 | Townsend et al. | 325/1 |
| 4,722,164 | 2/1988 | Scholler | 52/741 |
| 4,722,374 | 2/1988 | Bond | 144/345 |
| 4,918,799 | 4/1990 | Benedetti | 29/467 |

FOREIGN PATENT DOCUMENTS 2263156 6/1974 Fed. Rep. of Germany .

1728013 11/1975 Fed. Rep. of Germany .

*Primary Examiner*—Carl D. Friedman
*Assistant Examiner*—Lan C. Mai
*Attorney, Agent, or Firm*—Harris, Tucker & Hardin

[57] ABSTRACT

Improved methods of fabricating at least partially curved staircases include a first method in which preformed step structures have treads with curved slots formed in the underside of the ends which define a path for insertion of top edge segments of thin starter strips. The slots are collectively configured to laterally deflect the inserted starter strips in a manner longitudinally conforming them to at least partially curved paths of the overall stringer structures in the completed staircase. The stringers are then laterally built up and completed by securing reinforcing structures to the side surfaces of the laterally deflected strips. A second method uses preformed cooperating treads and risers themselves as a form which defines an at least partially curved path for the stringers. Simple temporary supports both position the cooperating treads and risers and provide a solid support for laying up strips from the inside out to form stringers to support the stair and back finishing strips along curved paths defined by the cooperating treads and risers wherein the finishing strips have edges configured to interengage the outer ends of the cooperating treads in a rigid assembly and form smooth sides of the staircase. The procedure is designed to allow the stringers to be made from flexible strips which are conveniently boxable and shippable because smooth butt joints are made while the ends are solidly supported and thus prefabricated staircase kits are made practical.

7 Claims, 7 Drawing Sheets

METHODS OF MANUFACTURING CURVED STAIRCASES AND STAIRCASES PRODUCED

This is a divisional application of U.S. patent application Ser. No. 07/800064, filed Nov. 27, 1991, now U.S. Pat. No. 5,163,491 which is a continuation-in-part application of U.S. patent application Ser. No. 468,758 of the same inventor entitled Improved Methods of Manufacturing Curved Staircases, filed Jan. 23, 1990, for which benefit under 35 U.S.C. §120 is claimed, now abandoned.

BACKGROUND OF THE INVENTION

The present invention relates generally to the fabrication of at least partially curved staircases, and more particularly relates to improved methods of constructing such staircases which uniquely eliminate many of the labor and cost inefficiencies heretofore associated with conventional curved staircase construction techniques.

Conventional factory fabrication of a curved staircase, for subsequent shipment to an installation site, is typically initiated by the laborious construction of a horizontally spaced pair of temporary vertical support walls with curvatures conforming to the curved paths which the opposite sides of the completed staircase will ultimately assume. The opposite sides of the staircase, in the form of elongated "stringer" structures, are then secured along their lengths to these support walls in the predetermined curving and rising paths of the staircase sides.

The staircase stringers are typically of a laminated wooden construction formed by elongated thin wooden laminae which are glued together in the usual side-to-side orientation. In forming each stringer it is customary to secure one or more initial layers thereof to its associated support wall and then secure and glue successive layers to the previously secured layer(s) until the stringer is laterally built up to its necessary thickness.

After the stringers have been formed in place in this manner on the support walls, careful measurements are made and riser/tread notches are hand-cut into upper side edges of the stringers for later receipt of the riser and tread portions of the individual step structures which will extend across the stringers. It is necessary that these riser/tread notches be cut into the stringers after the stringers are laterally built up to their full widths. It is exceedingly difficult, if not impossible, to pre-cut the riser/tread notches in the individual stringer laminae and then have them properly align with their adjacent laminae notches in the subsequently built-up stringers.

Next, careful measurements are taken on and between the completed stringers for the purpose of fabricating the individual riser and tread member portions of the staircase. When these staircase components are subsequently fabricated, they are operatively positioned on and secured to the temporary wall-supported stringers. Finally, the partially completed staircase is carefully removed from the temporary support walls for pre-finishing and shipment to the job site where attachment of the remaining staircase components (such as the handrail and balusters) and installation of the completed staircase are carried out.

Even from the brief description above, it can readily be seen that the conventional fabrication of a curved staircase is fraught with tedium, complexity, expense and a variety of potential constructional inaccuracies. For example, great care and a considerable amount of construction time are typically required to accurately erect the temporary support walls onto which the stringer and step portions of the staircase are initially built. Additionally, a similar amount of care is required to correctly lay out the curved, rising stringer paths on these walls so that the completed stringers are accurately configured with respect to both their rises and their curvatures. Further, because the built-up stringers ultimately determine the precise shapes and dimensions of the risers and treads, a great deal of hand forming, matching and fitting is required to fabricate these staircase elements and operatively secure them to the stringers.

After all of this is done, of course, the task still remains to remove the completed staircase portion from its associated support walls and ready the finished staircase structure for shipment. Because a curved staircase of this type is often of a one-of-a-kind custom design, the laboriously constructed support walls are, in most instances, simply torn apart and scrapped since they are of no use except in constructing that particular staircase or one essentially identical thereto.

Additionally, because the stringer structures must be bent around the temporary support walls (around either their inner or outer side surfaces) and firmly secured thereto, the outer side surfaces of the stringers, which would normally define the "finished" outer side surfaces of the completed staircase, are frequently marred or otherwise damaged. This typically necessitates the securement to the stringers of a sheet of finishing veneer material after their removal from the temporary support walls, thereby further adding to the overall labor time and expense associated with the staircase.

The complexity and precision entailed in this conventional staircase fabrication technique renders it, as a general proposition, unsuitable for on-site use by a general construction contractor. Accordingly, at the present time it is normally carried out only in a factory setting by skilled woodworking artisans.

The conventional approach referred to above is further detailed in U.S. Pat. No. 4,722,164 (1988) which proposes a departure from the conventional approach. The main embodiment creates uniform treads with curved ends to which long, flexible rectangular strips are nailed or doweled through the strip into the end grain of the treads. This causes the long strips to curve and the strips are later built up over the initial strip to form supporting stringers which are finished and veneered. A secondary embodiment has a long outer flexible strip on each side with cut out tread receiving areas on which treads rest. The treads have a separate piece referred to as a bead secured to the underside of the treads. The lengthy flexible strip on each side is screwed from the inside to the "bead" secured to the bottom of the treads, and said to cause a curve, although the disclosure is incomplete. The single long strip on each side is then built up to form a stringer by laminating narrower long strips along its inside bottom.

The approach of U.S. Pat. No. 4,722,164 has a number of disadvantages for which the present invention is an improvement. The structure it creates is highly dependent upon a number and the adequacy of fasteners as opposed to quality joinery, fasteners which inevitably work loose resulting in a shaky construction. The dependence on a single flexible strip to form the initial stringer creates the necessity to have flexible boards which are longer than those commercially available because the curved path of the stringers, especially the outside stringer, is very long. Any attempt to make butt joints between pieces as suggested in that patent would result in kinks which deviate from a smooth path. If such long thin flexible boards are found (perhaps 30 feet long) the parts cannot economically be supplied in a boxable unit and so the curved stair would still have to be fabricated and assembled for all practical purposes, in a factory remote from the job site. The applicant is not aware of any wooden product meeting the requirements of the Scholler patent that is available in 20 to 30 foot lengths. It appears that any plywood used to make the secondary embodiment must require special joinery not disclosed, to avoid stiffness at the joints and thus the kinks or irregularities that would form when twisted into a compound curve. There is little or no demand for such long wooden strips that would have the requisite flexibility and surface quality. Laminating over the outside surface of the secondary embodiment is not suggested and is impossible due to the presence of the separate "bead" on the outside of the primary stringer layer. Only a single main stringer can be used in supporting contact with treads for the same reason. Lack of any suggested support would seem to create significant assembly problems.

From the foregoing it can be readily seen that it would be highly desirable to provide a more rapid, rigidly solid, attractive and inexpensive method of constructing a curved staircase. It would be desirable to make such a staircase which is boxable for assembly at a remote job site. It is accordingly an object of the present invention to provide such a method and the staircase so made.

SUMMARY OF THE INVENTION

In carrying out principles of the present invention, in accordance with a preferred embodiment thereof, an improved method is provided for fabricating an at least partially curved staircase defined in part by a series of riser-and-tread step structures which span and are operatively secured at their opposite ends to elongated stringer structures which extend along opposite sides of the completed staircase.

One method basically comprises the steps of forming first and second elongated flexible stringer starter strips each configured to define only a relatively small horizontally lateral portion of one of the stringer structures; forming the step structures; providing the step structures with means which function, in response to operative connection of the step structures to the starter strips, to laterally deflect the starter strips to the desired at least partially curved longitudinal paths of the stringer structures in the completed staircase; operatively securing the step structures to the stringer starter strips to laterally deflect the strips into longitudinal conformance with the curved stringer paths; and reinforcing the laterally deflected stringer starter strips to complete the formation of the stringer structures.

Due to the use of the flexible stringer starter strips as "forms" for the completed stringer structures, and the incorporation of the strips into the completed staircase, the previous conventional way of erecting (and subsequently tearing down) temporary stringer support walls is totally eliminated, thereby substantially reducing the labor and fabrication time associated with the staircase.

Utilizing the method for the present invention, the fabrication of a desired staircase is preferably initiated by creating an accurately scaled top plan view of the staircase and obtaining from such plan view, preferably by computer, dimensional fabrication data relating to the step and stringer structure portions of the staircase. The dam obtained from the plan view may be transferred to appropriate computer-controlled wood cutting and forming machinery which may be used to precisely form the stringer starter strips and step structure components.

In a preferred embodiment of the first method, the stringer starter strips are formed with machine cut riser/tread notches in upper side edges thereof, each notch being bounded by riser and tread edge portions of a longitudinal segment of its associated strip. Additionally, preferably under computer control, slots are cut in the bottom sides of the tread member portions of the step structures at their opposite ends.

Each of these slots has a curvature precisely identical to that of the longitudinal starter strip segment positioned immediately adjacent thereto, as determined from the originally created staircase plan view, and has a width just slightly larger than the starter strip thickness. In assembling the staircase, the tread edge portions of associated tread member end slots function to laterally deflect the stringer starter strips and automatically bring them into precise longitudinal conformance with the at least partially curved paths of the stringer structures shown on the plan view of the staircase.

With the step structures anchored to the laterally deflected starter strips, for example with glue and wood screws, the strips are used as "forms" for completing the overall stringer structures by attaching reinforcing structures (preferably of a built-up laminated wooden construction) along the lengths of side surfaces of the deflected strips.

A second method of fabricating an at least partially curved staircase, and the staircase formed by the method, employs the treads and risers as a form for defining at least partially curved paths to be followed by inside and outside stringers laid up along curved paths from flexible stringer strips. Cooperating treads and risers are formed to make up and follow a particular curved run of staircase wherein the treads have opposite end portions formed to define an inside curved path at an inside end portion and an outside curved path at an outside end portion. Some of the cooperating treads and risers are connected in a desired curved operating position along a portion of said curved run and supported by means of pairs of inside and outside supports located laterally inwardly from the opposite inside and outside end portions of the treads at a position wherein a side of one of the pairs of supports defines the location of the innermost side edge of an inside stringer and a side of the other of the pairs of supports is laterally positioned to define the location of the innermost side edge of the outside stringer so that the stringers when completed will have an opposite outside side edge lying along one of the at least partially curved paths defined at each of the opposite ends of the treads. Each of the sequential cooperating treads and risers are positioned and supported in a similar manner to follow the curved run which may extend from a lower floor to an upper floor of a building.

The supports thus perform a dual role in that they serve to support the cooperating treads and risers along a curved run in operating position in which the treads are generally horizontally oriented, and at the same time are positioned to provide a support surface at a plurality of locations against which a plurality of thin, flexible elongated and generally rectangular shaped strips are laid up to form stringers in supporting contact with the cooperating treads and risers. When built up, generally rectangular shaped curved stringers are formed which have an outside surface lying along the at least partially curved inside and outside curved paths defined by the treads. The support members used to support the individual cooperating treads and risers uniquely form a solid support surface which serves to permit forming inexpensive butt joints between individual thin strips used to form the stringers. It is simple and easy to make a plumb cut of the end of an elongated thin strip at the center of a support in order to create a butt joint with the next upwardly spiraling initial thin flexible strip at the extreme laterally inward side portion of the inside and outside stringers to be formed. Because the ends of the strips are being supported where they come together by support members, a smoothly curving stringer can be formed without "kinks". Once the first such strip is laid up along the complete length, subsequent strips can be added using butt joints which do not necessarily have to be formed at a support member because the initial strip forms a support surface to keep the butt joint from being "kinked" or otherwise forming an irregular curve where the ends of abutting adjacent strips come together.

Finally, at least the last layer of the outermost side of the inside and outside stringer strip is laminated using a special elongated flexible strip having sequentially arranged cut-away upper edge means for engaging the cooperating treads and risers along portions of the respective inside or outside curved paths formed on the inside or outside portion of sequentially assembled treads. The cut-away upper edge means has generally triangularly shaped adjacent cutout portions having longitudinal segments which lie horizontally in operating position and may be placed in supporting contact with notched portions on the ends of the treads cut to define one of the inside or outside curved paths to form a smooth curve along the edge of the stairway, in assembly, and cover the remainder of the curved laminated stringer and enclose the ends of the risers and hide them from view. Corresponding notches located in the opposite end portions of the risers located vertically in the plane of the respective inside and outside curved paths may be supportingly engaged at a vertical edge portion of said upper edge means on the outermost special flexible strip to form a strong and smooth side edge along each side of the assembled stairway. A second special elongated flexible strip may be laid up along the first special elongated flexible strip to further follow and engage the notched ends of the cooperating treads and risers to form more solid inside and outside stringers and reduce the tendency to act like a hollow sounding board. The second special flexible strip can be of solid wood, as opposed to less expensive plywood, which can be finished up to complement the other visible fine wood surfaces.

Because the methods of the present invention provide accurately pre-formed stringer and step structure components which may be subsequently and quite simply assembled without precise measurement, fabrication or inordinate skill, the present invention also permits a curved staircase to be conveniently packaged in relatively compact component kit form for shipment to the job site for rapid assembly there by workers with only ordinary carpentry skills. Because the staircase is shipped in unassembled form, both the shipping volume and cost are considerably reduced. If desired, the kit may also include the baluster and handrail portions of the staircase.

In addition to the cost savings achieved through the elimination of the previously necessary temporary support walls upon which the entire stringer structures were formed prior to attachment thereto of the step structures, the method of the present invention may provide further costs savings by computer-coordinating the dimensions of the stringer starter strips and the step structure components and permitting their fabrication to be automated.

A further advantage is provided by the staircase fabrication methods of the present invention in that, since temporary support walls are not used, the outer side surfaces of the stringer starter strips do not become marred during staircase construction since the strips do not have to be clamped or otherwise firmly secured to a support structure to conform them to curved paths while the step structures are being secured thereto. This permits the installed starter strips to define the finished outer side surfaces of the completed staircase without the necessity of laboriously attaching sheets of finishing veneer thereto. The previously mentioned reinforcing structures may be conveniently attached to the in-place starter strips along their inner side surfaces where they are essentially hidden from view.

DETAILED DESCRIPTION

Figure 1:
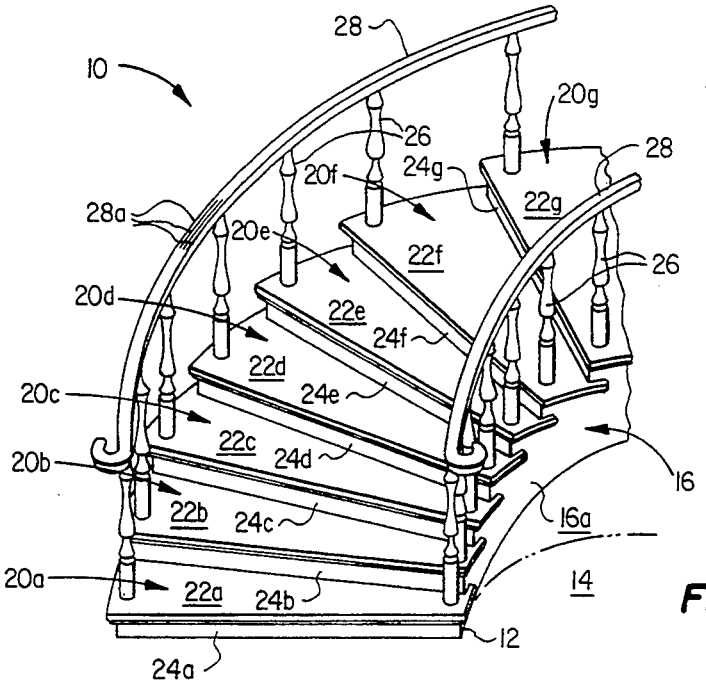
FIG. 1 is a perspective view of a lower end portion of a curved staircase fabricated using an improved method of the present invention.
Figure 2:
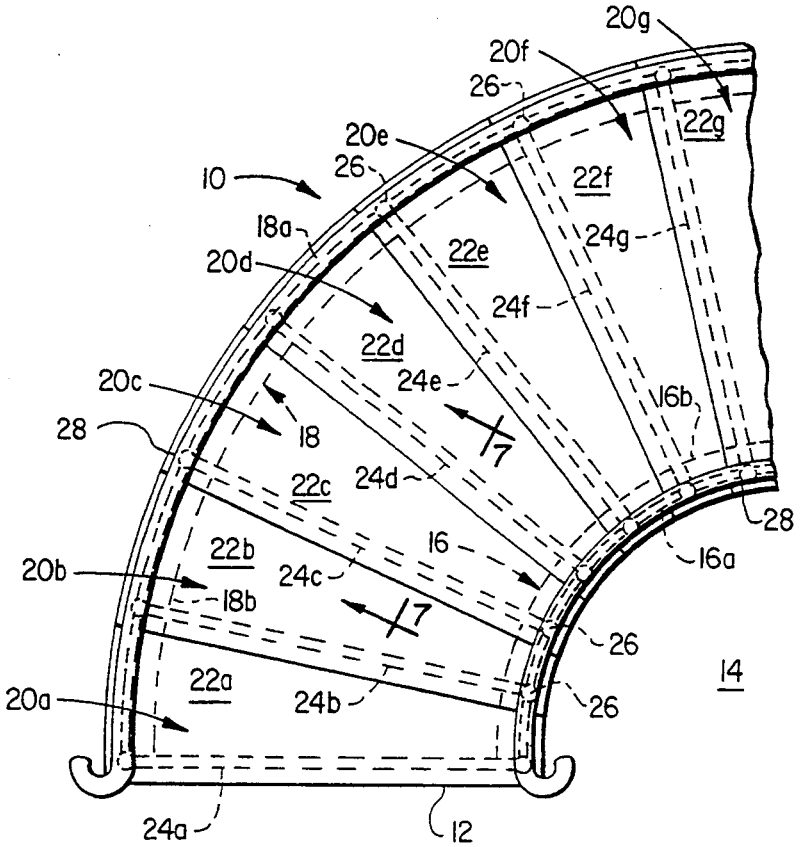
FIG. 2 is a top plan view of the staircase portion.

Illustrated in FIGS. 1 and 2 is a lower end portion of a curved staircase 10 which has been fabricated by a first method of the present invention. From its lower end 12 the staircase 10 curves and rises relative to the floor 14, and includes laterally spaced apart, oppositely disposed elongated stringer structures 16, 18 that define opposite side portions of the staircase which extend along generally parallel, but differently radiused, curved paths up and around the length of the staircase.

Spanning the stringers 16, 18 are progressively higher step structures $\mathbf{20}_a$–$\mathbf{20}_g$ each defined by associated horizontal tread members $\mathbf{22}_a$–$\mathbf{22}_g$, and vertical riser members $\mathbf{24}_a$–$\mathbf{24}_g$, each secured at opposite ends thereof to the stringers 16, 18 in a manner subsequently described. Completing the staircase 10 are vertical baluster members 26 secured to the opposite ends of the tread members and supporting curved handrails 28 in the usual fashion. The handrails 28 are conventionally fabricated in a laminated fashion from elongated thin wooden strips $\mathbf{28}_a$.

As a preview of the subsequent detailed description thereof, it should be noted that the method of the present invention used to fabricate the representatively illustrated curved staircase 10 departs radically from conventional curved staircase construction methods in several regards. For example, the use of, and indeed the necessity for, vertical support walls upon which the stringers 16, 18 are constructed as the initial fabrication step is completely eliminated. Additionally, as will be seen, the laminated stringers are not fully built-up before riser/tread notches are formed therein, and the step structures are used to quickly and precisely create the desired stringer curvatures instead of having to conform each step structure to its associated portions of pre-built stringers.

This unique reversal of conventional curved staircase construction methodology, coupled with the elimination of the temporary support walls, substantially reduces the overall fabrication time and expense associated with forming the staircase 10. The staircase fabrication method which will now be described also advantageously permits the construction of stringer and step structure portions of the staircase to be automated, and further allows the staircase 10 to be shipped entirely in component "kit" form to the job site where it can be easily erected by workers with normal carpentry skills.

In a preferred embodiment thereof, the first curved staircase fabrication method of the present invention is preferably initiated by creating an accurately scaled top plan view of the staircase to be built. A portion of such a top plan view, for the representative staircase 10, is depicted in FIG. 2. From this top plan view, which may be conveniently generated by a computer, a variety of useful horizontal dimensional data for the various staircase components is rapidly determined.

Specifically, among other dimensional data, the precise plan view shape of each tread member 22, the overall length of each stringer, and the precise curvature and length of each longitudinal stringer segment to which each step structure is to be secured at riser/tread notches in the stringers are determined. Given the predetermined total vertical rise of the staircase, and the individual tread-to-tread riser heights of the staircase, the top plan view is also utilized to determine the necessary longitudinally straightened side view configurations of the curved narrow outer side portions $\mathbf{16}_a$, $\mathbf{18}_a$ of the overall stringer structures 16 and 18, such outer side portions being hereinafter referred to as "stringer starter strips". The dimensional data obtained from the top plan view of the staircase 10, with respect to its stringer and step structure components, may be suitably downloaded into computer-controlled wood cutting and routing machinery which is utilized to quickly and very accurately form these components.

The top plan view of the staircase to be constructed may be conveniently generated using a conventional CAD (computer assisted drawing) program which automatically stores the dimensional data later utilized to form the aforementioned staircase components. Using conventional computer technology, this stored dimensional data may be suitably converted for downloading into computer-controlled wood cutting and routing machinery.

Figure 3:
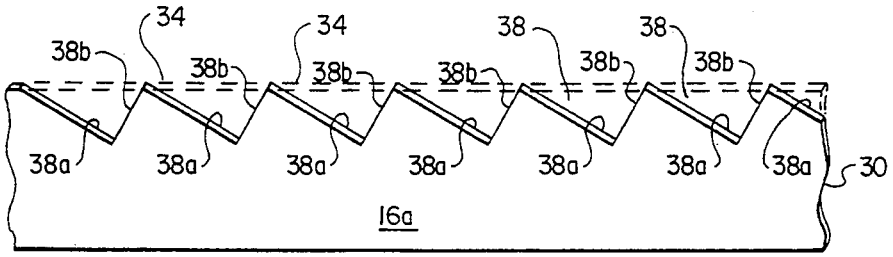
FIGS. 3 and 4 are perspective views of longitudinal sections of flexible stringer starter strips utilized in fabricating the staircase.
Figure 4:
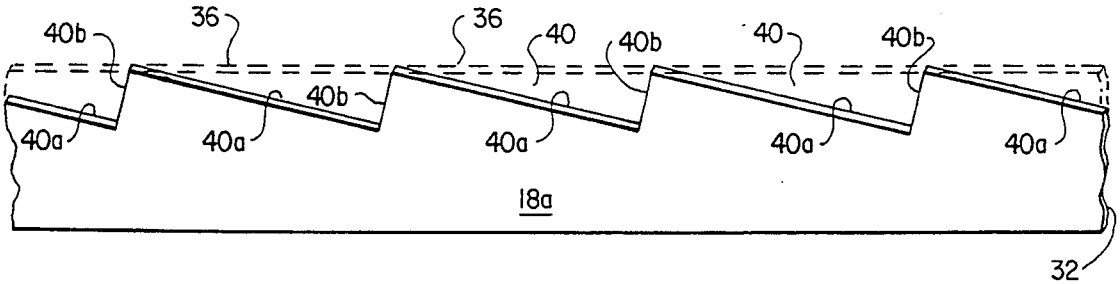
Figure 8:
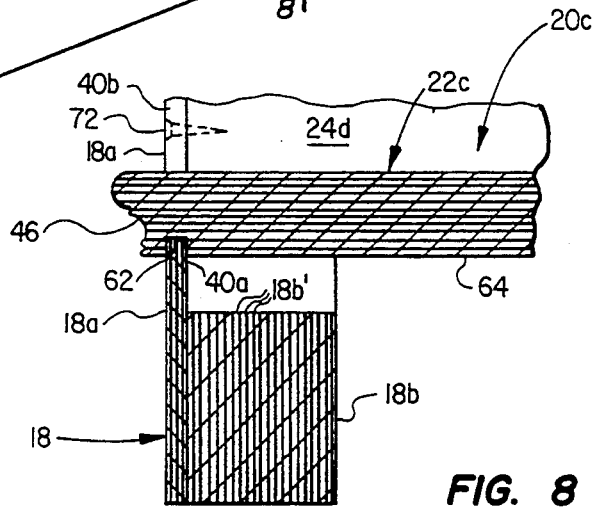
FIG. 8 is a partial cross-sectional view through the illustrated staircase portion taken along line 8—8 of FIG. 7.

Referring now to FIGS. 3 and 4, the stringer starter strips $\mathbf{16}_a$, $\mathbf{18}_a$ are preferably formed from elongated laminated wooden strips 30 and 32, the individual laminae are not visible in FIGS. 3 and 4 (but see FIG. 8 in this regard). The laminated strips 30 and 32, respectively, have lengths equal to or slightly longer than the stringer structures 16 and 18, and vertical depths (as viewed in FIGS. 3 and 4) corresponding to the vertical depths of the stringer structures 16, 18. The illustrated strips 30, 32 have overall thickness of approximately $\frac{1}{4}''$ and are quite flexible along their lengths, being hand bendable to deflect them from an essentially straightened orientation to the desired curvatures of the stringers 16, 18. While the strips 30, 32 are preferably of a laminated wooden construction, it will be readily appreciated that they could be formed from other thin, flexible materials such as plastic, fiberglass, metal or the like.

Using the dimensional data previously obtained from the top plan view of the staircase 10, a suitable computer-controlled wood cutting tool may be utilized to remove triangularly shaped portions 34 and 36 from the upper side edges of the strips 30 and 32 to thereby form the stringer starter strips $\mathbf{16}_a$ and $\mathbf{18}_a$, the removed portions 34, 36 defining in the starter strips $\mathbf{16}_a$, $\mathbf{18}_a$ longitudinal segment means comprising triangular riser/tread cutout areas 38 and 40. The total numbers of these cutout areas in each of the starter strips $\mathbf{16}_a$, $\mathbf{18}_b$ is equal to the total number of step structures in the completed staircase 10. As illustrated, each of the cutout areas 38 is bordered by perpendicularly disposed tread edge portions $\mathbf{38}_a$ and riser edge portions $\mathbf{38}_b$ (FIG. 3), and each of the cutout areas 40 is bordered by perpendicularly disposed tread edge portions 40, and riser edge portions $\mathbf{40}_b$.

The removal of the triangular strip portions 34 and 36 is conveniently carded out while the strips 30 and 32 are in longitudinally straightened orientations, thereby permitting the strips 30, 32 to be fed along a horizontal cutting table or the like. The cutout areas 38, 40 may be computer-dimensioned so that when the starter strips $\mathbf{16}_a$, $\mathbf{18}_a$ are laterally deflected to their final curved orientations (as seen in FIG. 2), the cutout areas 38, 40 will form properly positioned and configured riser/-tread notch areas to which the step structures are operatively secured as later described. That is to say, the length of the horizontal notch is made longer in the flat straightened orientation because when it is curved, it must traverse the cord of an arc of a radius dependent upon the inside or outside curvature of the staircase to be produced.

Figure 6:
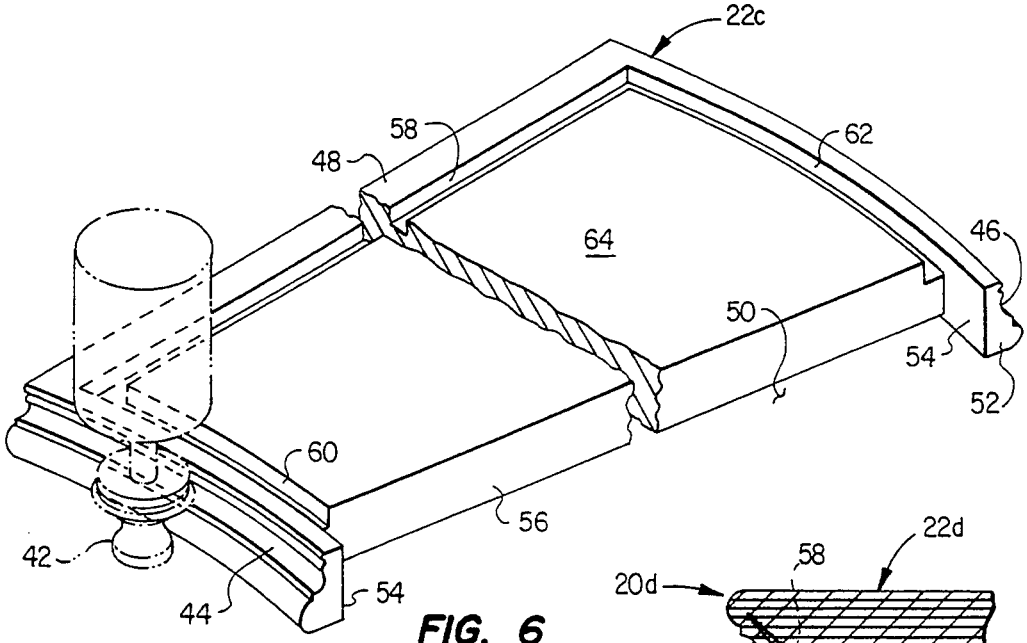
FIG. 6 is a longitudinally foreshortened bottom side view of one of the stair tread members used in fabricating the staircase.
Figure 7:
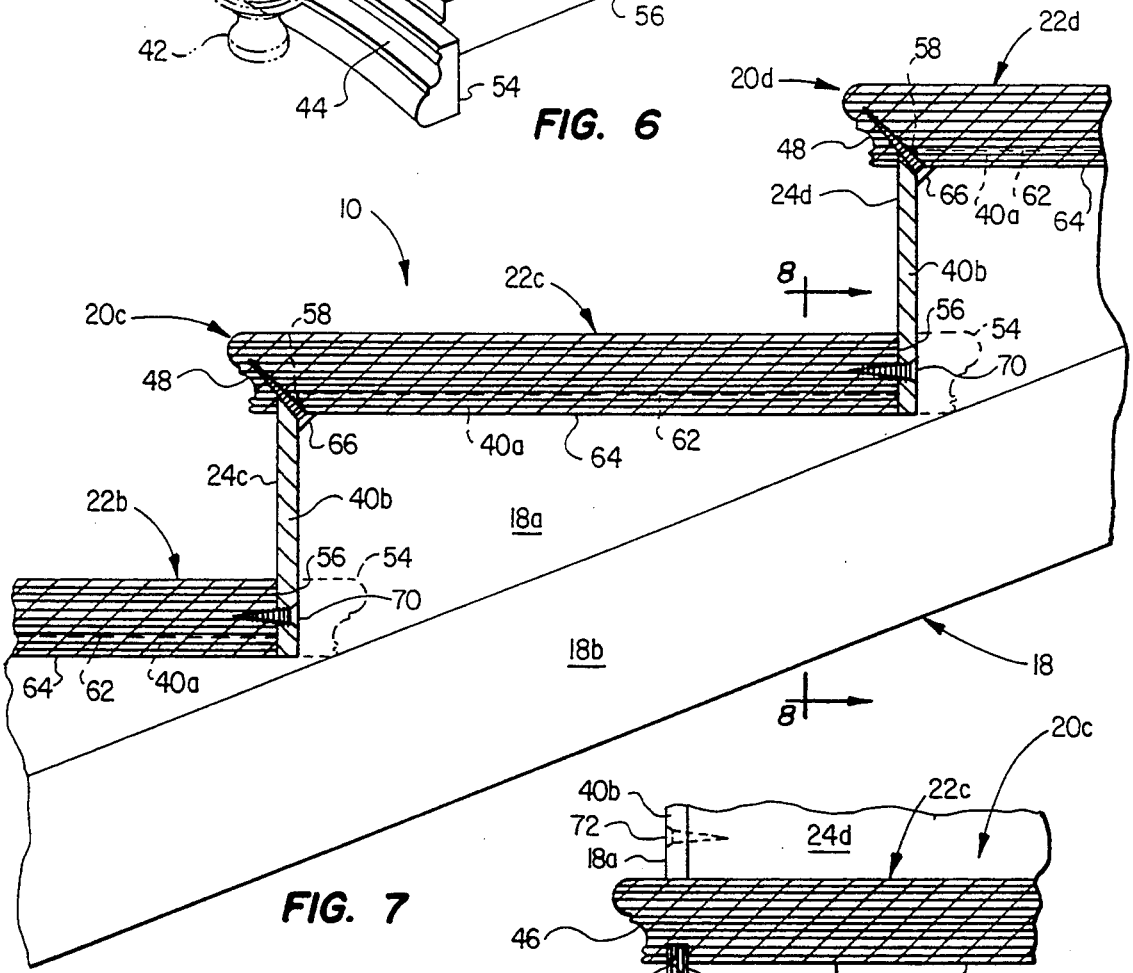
FIG. 7 is an enlarged scale partial cross-sectional view through the illustrated staircase portion taken along line 7—7 of FIG. 2.

Turning now FIGS. 6 and 7, the tread members 22 are preferably of a laminated wooden construction as illustrated in FIG. 7, and may be brought to their final shape, from oversized laminated wooden "blanks", by computer-controlled wood forming and cutting machinery such as the router 42 shown in FIG. 6 forming the edge periphery of the representative tread member $22_c$ and shaping a decorative molding pattern along its opposite end edges 44, 46 and its front edge 48. For purposes later described, an elongated slot 50 is cut by a computer-controlled tool into the rear side edge 52 of the tread $22_c$, the slot 50 creating rearwardly projecting molding tabs 54 at the opposite ends of the riser $22_c$. As illustrated, the molding tabs 54 project rearwardly beyond a resulting recessed rear side edge portion 56 of the tread $22_c$.

A computer-controlled routing tool may be utilized to form three rectangularly cross-sectioned slots 58, 60 and 62 into the bottom side surface 64 of the tread $22_c$. Slot 58 is positioned rearwardly of the straight side edge 48 and extends parallel thereto, stopping at its opposite ends inwardly of the opposite end edges 44 and 46. Slot 60 extends from the recessed rear side edge surface 56 to the slot 58, inwardly of the side edge 44, and has a curvature precisely corresponding to the curvature of the longitudinal segment of the stringer starter strip $16_a$ directly beneath the narrower end of the tread $22_c$ in the assembled staircase portion depicted in plan view FIG. 2. The slot 62 extends from the recessed rear side edge surface 56 to the front side slot 58 and is positioned inwardly of the tread end surface 46. The slot 62 has a curvature precisely identical to that of the longitudinal segment means of the stringer starter strip 18, which underlies the wider end of the riser $22_c$ in the assembled staircase portion depicted in plan view in FIG. 2.

Each of the other tread members is formed in a manner similar to that just described in conjunction with the representative tread member $22_c$ shown in FIG. 6. Accordingly, each of the other tread members is provided with the rear side notch 50, the front side slot 58, and the end slots 60 and 62 which conform to the curvatures of the longitudinal segments of the stringer starter strips $16_a$, $18_a$ which underlie these end slots as shown in FIG. 2.

After forming the tread members 22 and the rectangular wooden riser members 24, the step structures 20 are formed by inserting top side edge portions of the riser members into the front side slots 58 of their associated tread members 22. For example, as illustrated in FIG. 7, the step structure $20_c$ is constructed by inserting a top side edge portion of the riser member $24_c$ into the front side slot 58 of the tread member $22_c$. The inserted top side edge portion of the riser member $24_c$ is glued into its associated slot 58 and may be further secured therein using wood screws 66. The step structures 20 are then operatively connected to the stringer starter strips $16_a$ and $18_a$ in a manner which will now be described in conjunction with FIGS. 5, 7 and 8.

With the stringer starter strips $16_a$, $18_a$ supported in a spaced apart, laterally facing relationship on a suitable support surface, such as a factory floor 68, each assembled step structure 20 is operatively secured at its opposite ends to the stringer starter strips $16_a$, $18_a$ by hand bending longitudinal sections of the strips and upwardly inserting appropriate ones of the tread edge portions $38_a$ and $40_a$ into the curved end slots 60 and 62 of their associated tread member, and bringing the riser edge portions $38_b$, $40_b$ into engagement with the front side of their associated front side slots 58 outwardly of opposite end edges of the riser member 24 previously inserted therein.

Figure 5:
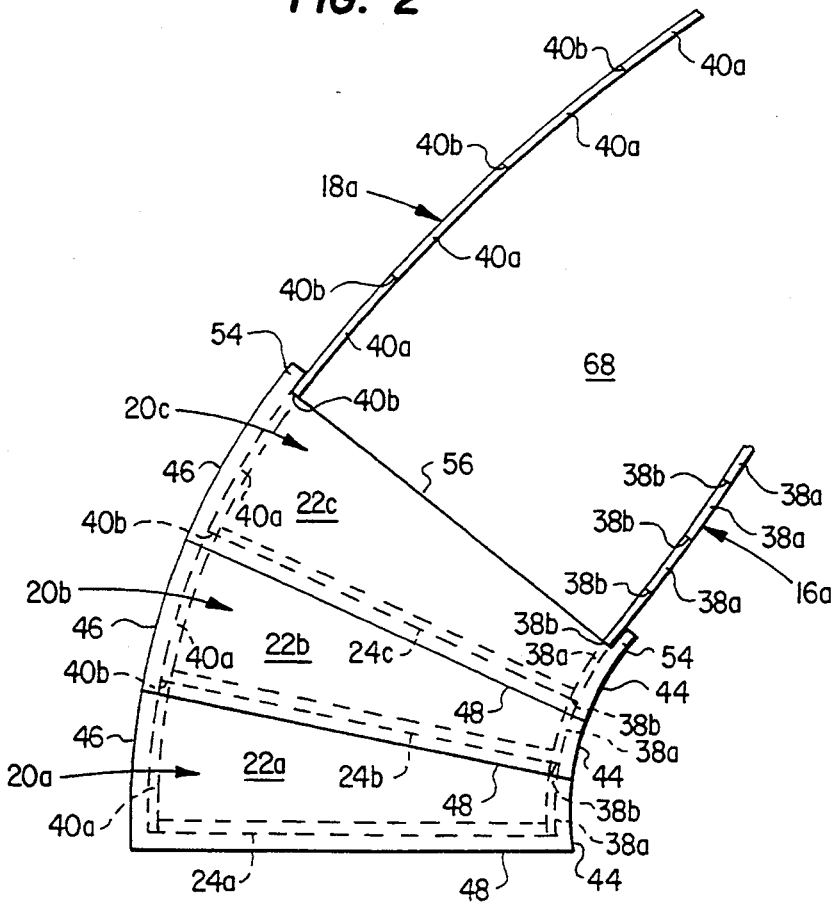
FIG. 5 is a top plan view of the stringer starter strips, with three of the staircase step structures initially secured thereto, and illustrates an improved method of fabricating the staircase utilizing principles of the present invention.

For purposes of illustration, FIG. 5 depicts the three step structures $20_a$, $20_b$ and $20_c$ already installed in this manner on the starter strips $16_a$, $18_a$ to begin the staircase construction at its lower end and progressing upwardly along the staircase. However, it will readily be appreciated that other longitudinal starting points could also be used if desired. As can best be seen in FIG. 7, the rear side slots 50 of the tread members 22 are dimensioned so that the recessed rear side surface 56 of each tread member engages the front side surface of one of the riser members 24. For example, the recessed rear side surface 56 of the tread member $22_c$ engages the front side surface of the riser member $24_d$. Additionally, the tab portions 54 of each tread member extend outwardly and rearwardly along the stringer starter strips as shown in phantom in FIG. 7.

As the step structures 20 are successively installed on the stringer starter strips $16_a$, $18_a$ in this manner, they are anchored to the starter strips by means of wood screws 70 installed through lower end portions of the riser members 24 into the tread members 22 (FIG. 7), and wood screws 72 (FIG. 8) installed inwardly through the starter strip edge portion $38_b$ and $40_b$ into opposite end edges of the riser members 24. Appropriate adhesive may be employed at each of the joints.

Quite importantly, the interfitting of the starter strip edge portions $38_a$ and $40_a$ with their associated tread member end slots 60, 62 automatically conforms longitudinal sections of the starter strips to the curvatures of their associated longitudinal sections shown in the finished plan view FIG. 2. Accordingly, the end slots 60 and 62 formed in the tread members 22 function as means for laterally deflecting the stringer starter strips $16_a$, $18_a$ from longitudinally straightened orientations thereof to the predetermined curved paths which they need to assume in the completed staircase 10.

Stated otherwise, in the present invention the curvatures of these lateral portions of the overall stringer structures 16 and 18 are established by an automatic interaction, during operative interconnection, between the step structures and the overall stringer starter strips. As opposed to conventional staircase construction methods in which it is necessary to initially erect the stringer structures along their ultimate curved paths, and then laboriously construct and hand-fit each step structure to its associated longitudinal portions of the pre-built stringer structures, the precise required curvatures of the stringer structures are created in the present invention by the pre-built step structures. Accordingly, and quite advantageously, the staircase construction methods of the present invention eliminates the previous necessity of constructing temporary support walls upon which the stringer structures must be formed.

Referring now to FIGS. 2, 7 and 8, after the stringer starter strips $16_a$, $18_a$ have been secured to and laterally deflected by the step structures 20 as previously described, elongated reinforcing structures $16_b$ and $18_b$ are secured to the inner side surfaces of the starter strips $16_a$, $18_a$, below the steps structures 20, to laterally thicken and strengthen the starter strips, and complete the formation of the overall curved stringer structures 16 and 18. As illustrated in FIG. 8, these reinforcing structures $16_b$, $18_b$ are preferably of a laminated wooden construction in which, for example, the individual laminae $18_b$ prime of the support structure $18_b$ are successively glued together in a side-to-side relationship to progressively thicken the illustrated support structure $18_b$ to its final projection depth away from the inner side surface of the stringer starter strip $18_a$. Similar reinforcing structures could be formed using other materials if desired.

After the formation of these reinforcing structures $16_a$, $18_b$ on the inner side surfaces of the previously installed, laterally deflected stringer starter strips $16_a$ and $18_a$, the interconnected stringer and step structure portions of the staircase 10 may be pre-finished and shipped to the job site for installation thereon of the balusters 26 and the handrails 28.

While the end slots 60 and 62 formed in each of the tread members 22 are particularly efficient in laterally deflecting the stringer starter strips to their final curved orientations, it will be appreciated that a variety of other cooperating means on the step structures 20 and the stringer starter strips $16_a$, $18_a$ could be utilized to create the desired lateral deflection of the starter strips.

The representative staircase portion illustrated in FIGS. 1 and 2 is of a rather simple configuration, having a constant rise and curvature, a constant width along its length, and no noncurved sections or horizontal landing portions. However, it will readily be appreciated that the principles of the staircase fabrication just described are also quite well suited to curved staircases of more complex configurations. For example, if the desired staircase had a noncurved section along its length, the end slots in the tread members at that section would simply be formed straight instead of curved (i.e., with a "zero" curvature). Similarly, the end slots in appropriate tread members could be configured to provide the stringer starter strips, and thus completed stringer structures, with more complex curvatures or combinations of curved and straight sections. Moreover, horizontal landing sections of the staircase would simply alter the upper side edge configurations of the stringer starter strips at the landing location.

All of these configurational variations could be obtained from the initial plan view of the staircase and appropriately transferred to the computer-controlled wood forming tool used to form the step structure and starter strip portions of the staircase. This wide design flexibility could also be provided when alternate cooperating deflection means were incorporated into the starter strips and step structures in place of the representatively described end slots provided in the tread members.

An additional advantage of the present invention is that it permits, as previously described, the fabrication of the step structure and stringer portions of the staircase to be automated, thereby substantially reducing the fabrication time and expense associated with the staircase.

As illustrated in FIG. 8, the reinforcing structure $18_b$ (like the opposite reinforcing structure $16_b$) is attached to the inner side surface of its associated stringer starter strip, thereby being essentially hidden from view in the completed staircase. In turn, this permits the stringer starter strips to define the finished outer side surfaces of the staircase without the necessity of securing finishing veneer sheets to their outer side surfaces. The ability to use the starter strips as the finished outer side surfaces of the staircases arises, of course, due to the fact that it was not necessary to clamp or otherwise firmly secure them to temporary support walls as in conventional staircase fabrication methods. Accordingly, the outer side surfaces of the starter strips are typically not marred or otherwise damaged during staircase construction sign the method of the present invention.

A further advantage provided by .the present invention is that it permits the factory-formed staircase components to be shipped to the job site in a very compact component kit form which may be contractor-assembled by workers with only normal carpentry skills. All that is necessary for such workers to do is, as previously described, construct the step structures, operatively secure them to the provided stringer starter strips, subsequently form the reinforcing structures, and install the balusters and handrails. A component kit of this type could include the pre-formed tread members, riser members, stringer starter strips and wooden laminae for use in fabricating the stringer strip reinforcing structures. If desired the kit could also include the balusters and the laminae for forming the handrails. Shipping the staircase in component kit form would of course, very substantially reduce the staircase shipping volume, and thus the overall shipping cost.

Figure 13:
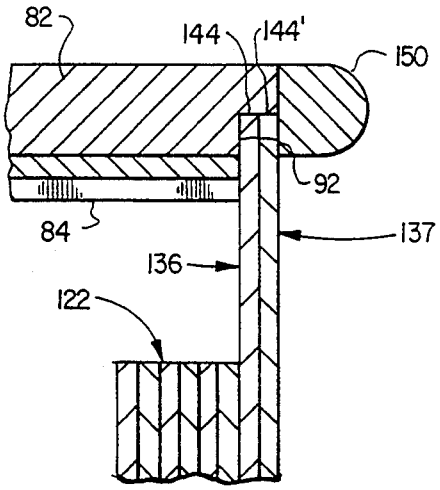
FIG. 13 is a cross-section on the line 13—13 of FIG. 10.
Figure 14:
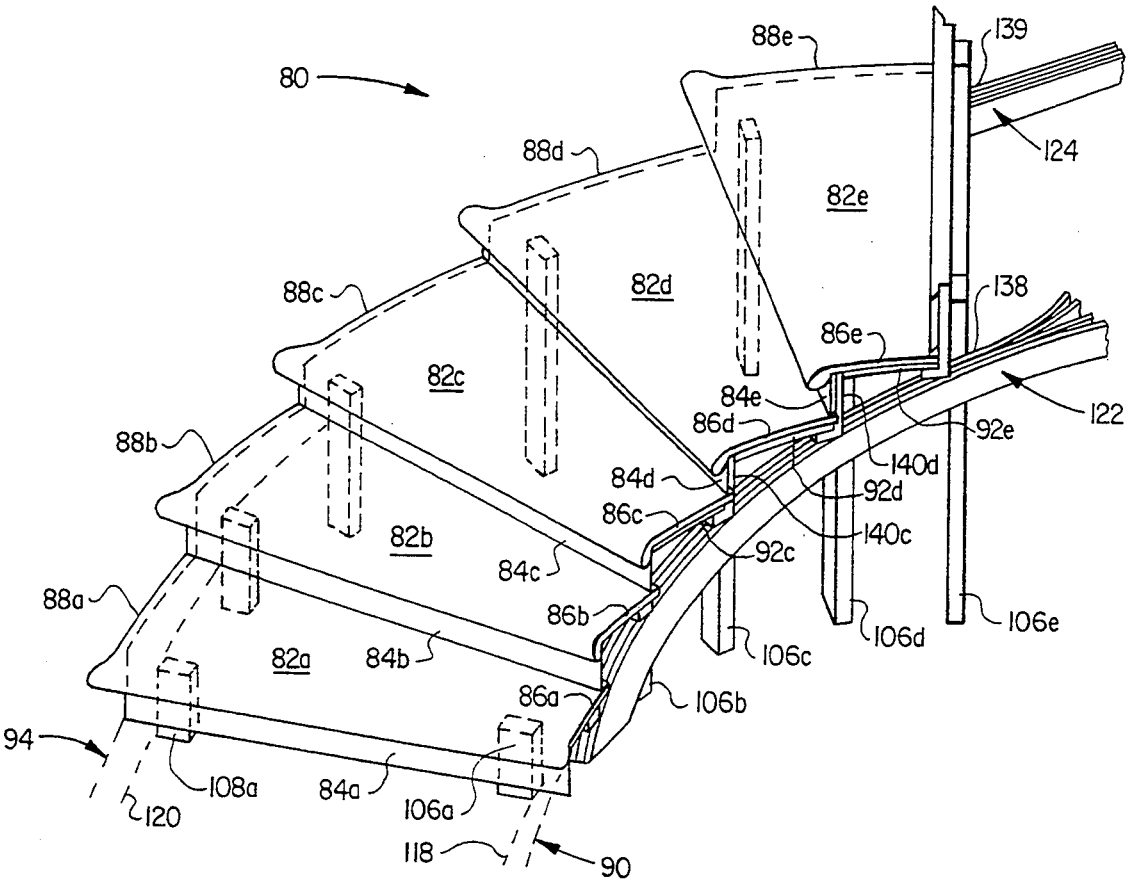
FIG. 14 is a perspective view from the front and inside looking down toward a partially completed run of curved staircase formed by the second method and supported in operating position.
Figure 15:
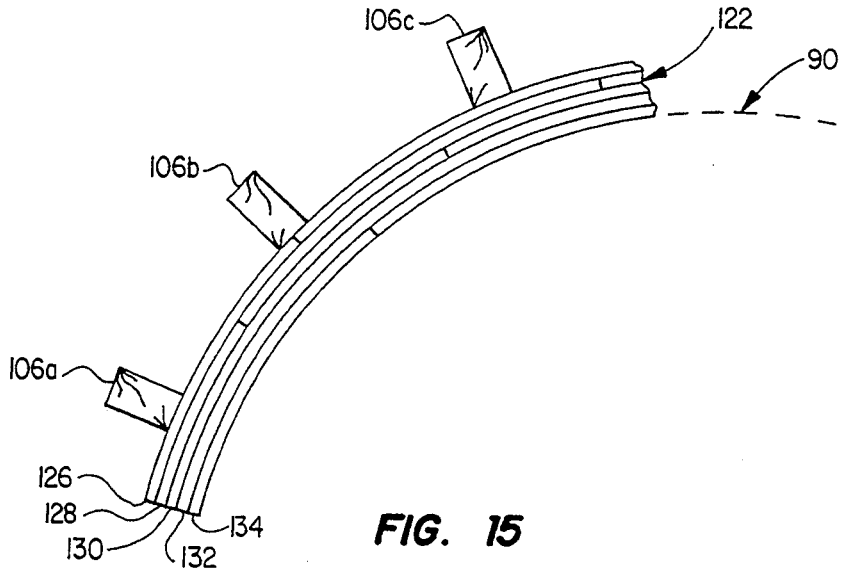
FIG. 15 is a top plan view of a section of the inside stringer laid along the supports under the cooperating treads and risers as seen in FIG. 14.
Figure 16:
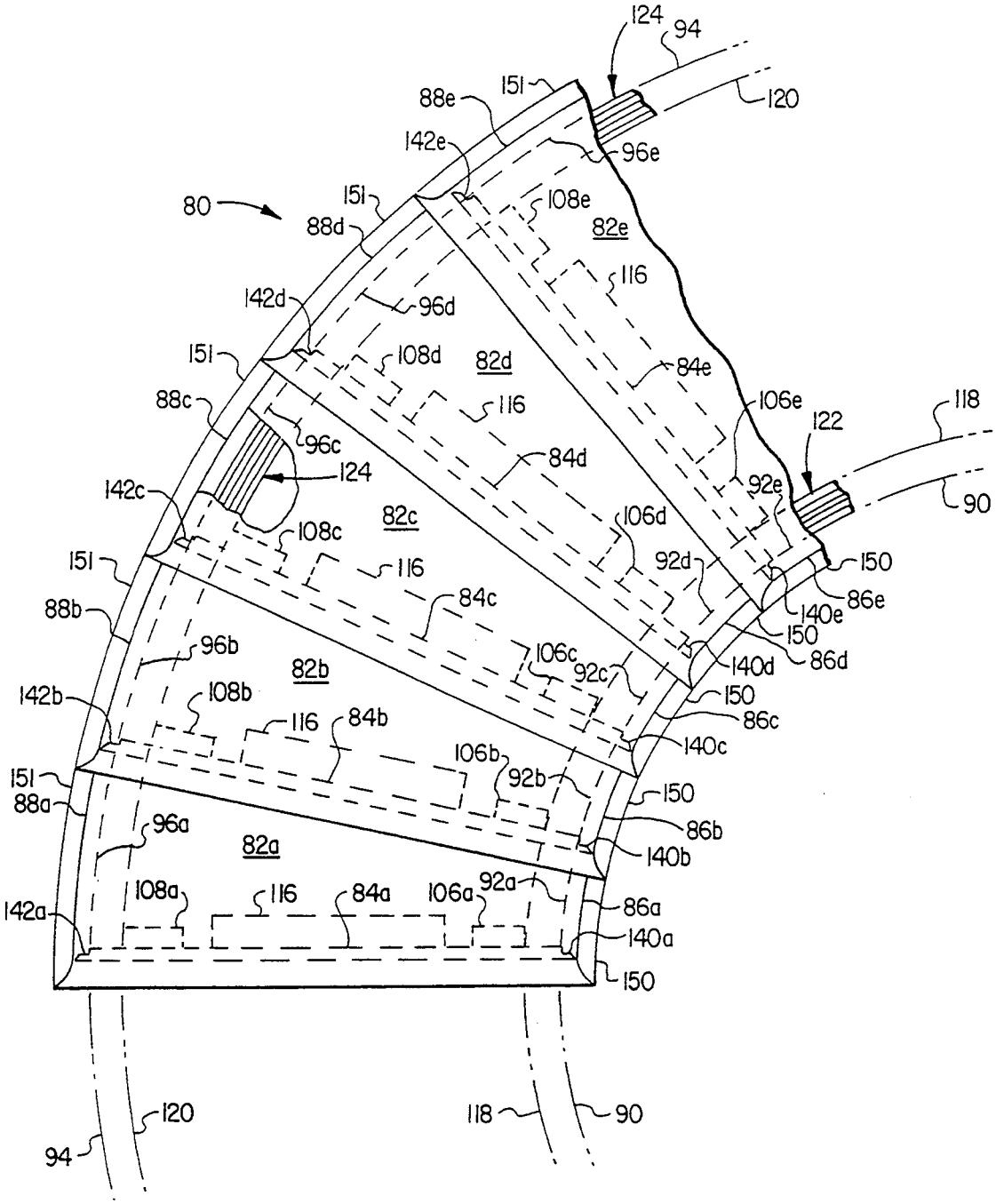
FIG. 16 is a top plan view of the curved run of staircase from FIG. 15 in assembled condition.

In FIG. 14 is an at least partially curved run of staircase designated generally by the reference numeral 80 produced by a second method. Staircase 80 has a plurality of cooperating treads 82*a–e* and risers 84*a–e*, for a curved run of staircase. The at least partially curved run of staircase 80 could be entirely curved in the form of a spiral, or it may contain curved and straight portions all connected together. The cooperating treads 82*a–e* may be regarded as having a general trapezoidal shape in plan view, having an inside end portion 86*a–e* formed to define an inside curved path designated generally by the reference numeral 90 as indicated in FIGS. 14–16. The underside surface of the inside end portion has a curved rabbeted elongated notch extending only partway through the thickness as seen from the side in FIG. 14 and are indicated in FIG. 16 as notches 92*a–e*. Although the notches are drawn in a straight non-curved orientation in FIGS. 9–13 for convenience in illustration, the structure shown in FIGS. 9–13 is identical except that the notches in the end portions of the treads in FIGS. 14–16 are placed in a curved orientation along one of an inside or outside curved paths.

Similarly, the outside end portions 88*a–e* at the opposite ends of the treads are formed to define an outside curved path 94 best indicated in FIG. 16. Again the underside surface of the treads 82*a–e* at the outside ends are rabbeted to define rabbeted notches 96*a–e* lying along outside curved path 94. The inside and outside curved paths 90, 94 may be thought of as curved vertical planes running through the center line of the curved notches when the treads are elevated and placed in operating position or orientation as indicated in FIG. 14 and FIG. 16.

Figure 11:
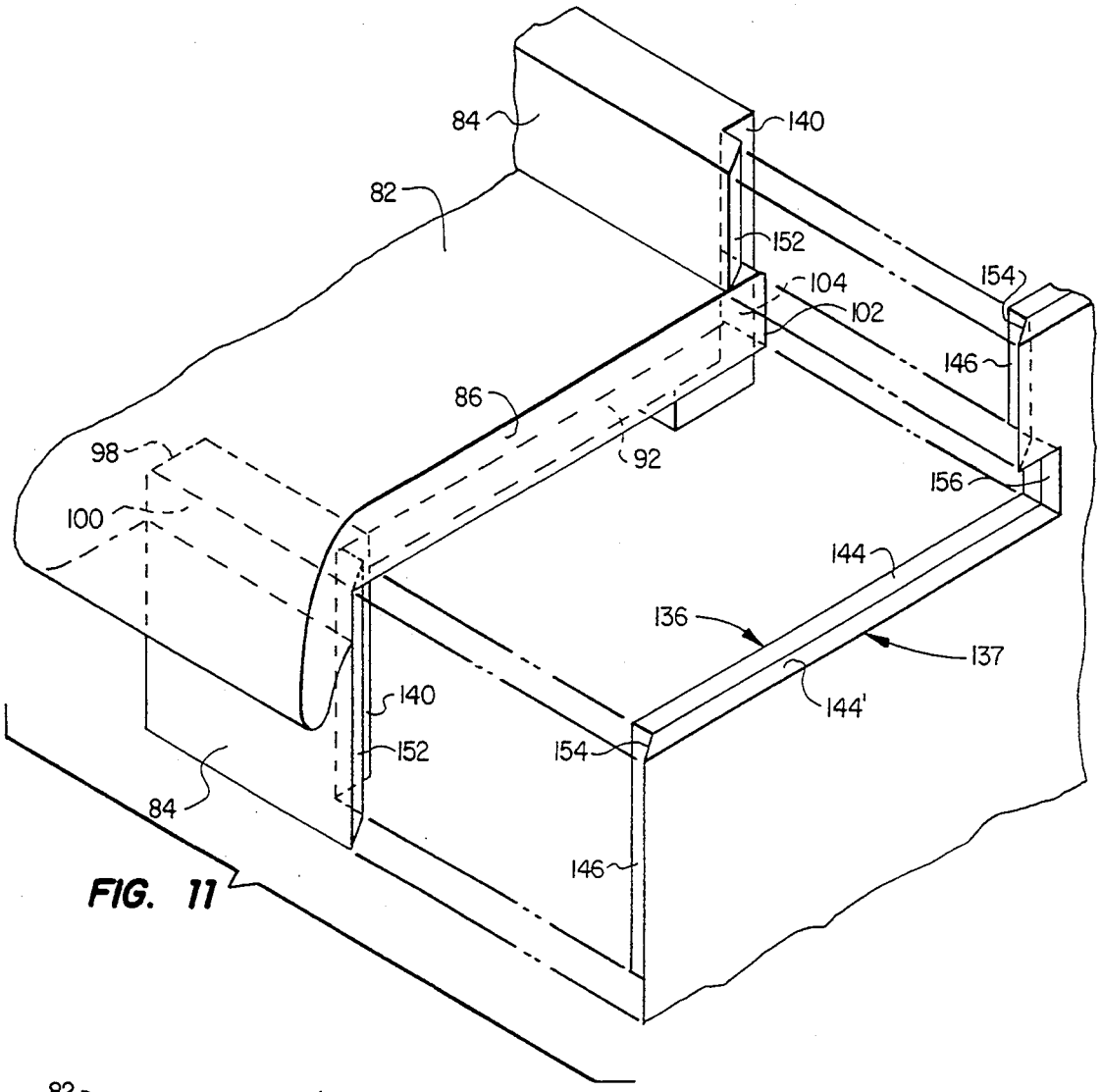
FIG. 11 is a detailed perspective view showing how the construction of the notched side edges of a tread and riser are fitted with the upper edge means of two thin, flexible strips.

The details of the preferred interconnection of the cooperating risers 84*a–e* and treads 82*a–e* are best visualized in FIG. 11 where a generalized cooperating riser 84 is interconnected with a generalized cooperating tread 82. Riser 84 has an upper end portion 98 which is received with respect to tread 82 in a fight angle orientation. The upper end portion 98 of the tread 84 is received in a dado 100 cut along the front underside surface of the tread 82. Generalized tread 82 has a rear end surface 102 that is received in a dado groove 104 which is cut across the front lower surface of the next riser 84 in operating position. Thus, each of the risers and treads are interconnected in turn sequentially as they proceed along the staircase run.

In order to form the at least partially curved run of staircase, it is preferable to position at least some of the cooperating treads and risers into a desired curved operating position along a portion of the curved run. The treads and risers are supported in the curved operating position by a series of supports located in a particular orientation. Pairs of supports are installed for each set of cooperating treads and risers.

In FIGS. 14 and 16 a set of inside supports 106*a–e* and a set of outside supports 108*a–e* are seen in pairs. The supports are located laterally inwardly from the opposite inside and outside end portions of the treads at a lateral position wherein a side of each support, designated generally as supports 106 and 108, defines the innermost side edge of respective inside and outside stringers 122, 124 which when completed will have an opposite side edge lying along one of said at least partially curved paths 90, 94. Each of the pairs of supports 106, 108 have the same length, are oriented vertically and preferably attached to the rear surface of the risers. The upper end is preferably in abutting contact with the undersurface of the cooperating tread above. Fasteners 114 seen in FIGS. 9–10 secure the supports but the fasteners do not extend all the way through to the front surface. Later, when the supports are removed, nothing can be seen from the front side.

It might be noted at this point that in the event the upper end portions 98 of the risers is not to be received in a dado 100 running along the length of the front underside surface of the treads, the upper ends 98 of the risers might be abutted against the undersurface of the treads and secured by angled supports like wedge shaped supports 116, secured with fasteners 114. In the event that risers were not to be used at all, the supports 106*a–e* and 108*a–e* might be placed with their upper end in abutting contact with the undersurface of the respective treads and fastened with screws 114 into the rear edge surfaces of the next lower tread. Angled support 116 might be placed against the rearmost side of the supports 106–108 and temporarily fastened by means of angled fasteners 114.

The remainder of cooperating treads and risers are interconnected and positioned and supported along the remainder of the curved run by additional ones of the supports 106*a–e*; 108*a–e*, indicated generally as 106, 108, at a plurality of places along the staircase run. Each of the temporary supports 106*a–e* and 108*a–e* are laterally positioned so that they have an outermost edge surface which can be seen as lying along a smoothly curved line in FIG. 16 to form the innermost edge line 118 and the outermost edge line 120.

Thin flexible stringer strips axe laid up along the respective inside and outside lines formed by the supports to form respective inside and outside stringers designated generally as inside stringer 122 and outside stringer 124. Although outside stringer 124 is partially hidden in FIG. 14 it follows the path shown in FIG. 16 and is the same as inside stringer 122 except, of course, formed along a greater radius. The respective inside and outside stringers 122, 124 axe formed by laying up multiple, flexible strips of common width along the supports 106, 108 in supporting contact with cooperating treads and risers until the last of the strips of the respective inside and outside stringers so formed, lie along the at least partially curved paths 90, 94 defined by the opposite end portions of the cooperating treads and risers.

Figure 9:
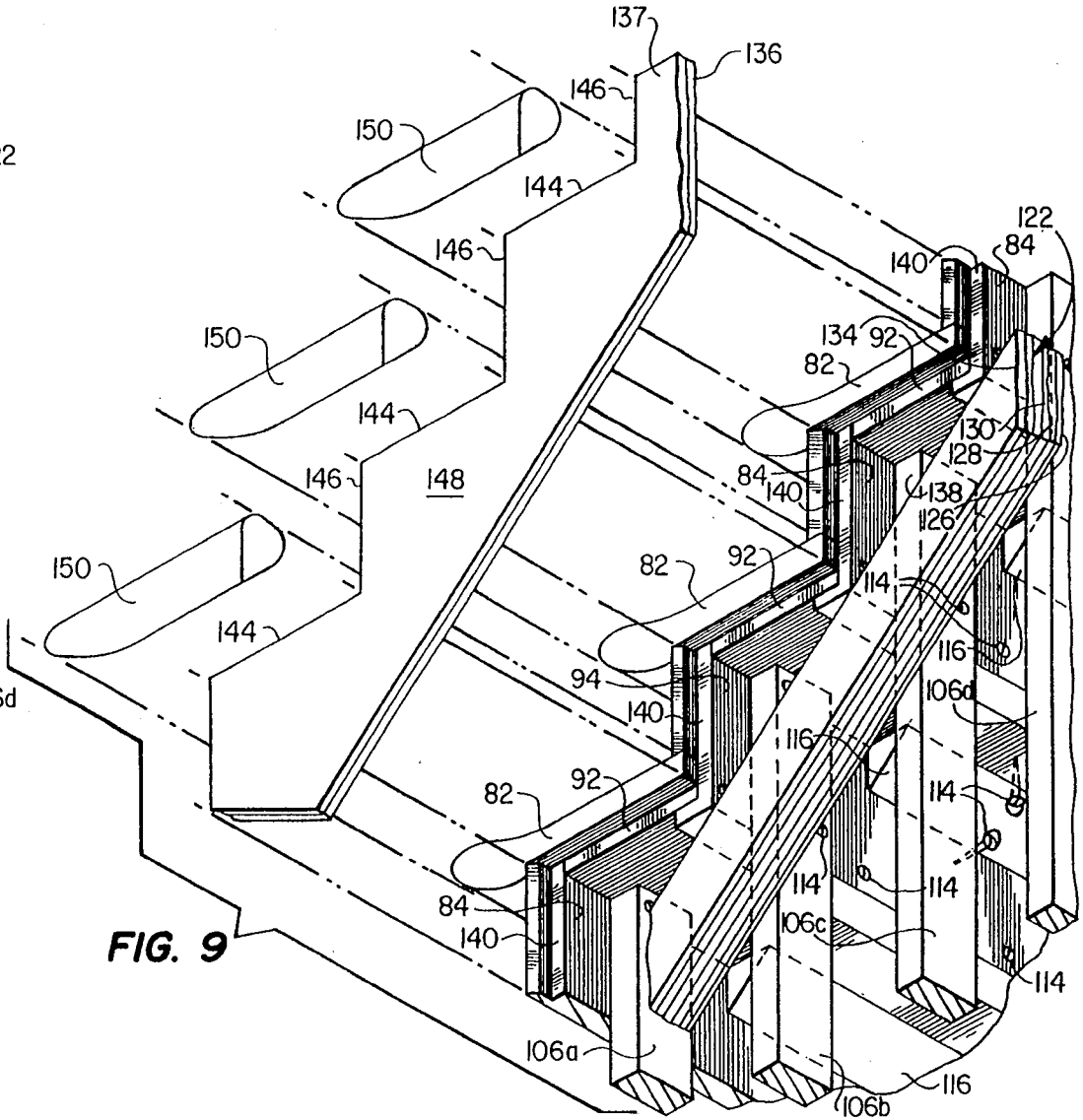
FIG. 9 is an exploded lower side perspective view of a portion of a staircase formed with the second method which is shown as though it were from a linear segment of the staircase.

The stringers 122, 124 are made up by laying up and laminating multiple, flexible strips, such as flexible strips 126, 128, 130, 132 and 134 in FIG. 15. These strips are of common width and are laid up so that they have upper edge portions in supporting contact with the lower rearwardmost portions of the cooperating treads and risers. The same is true whether the stringers are in a curved portion of the run of staircase or in a straight orientation as illustrated in FIG. 9. The upper edge portion of the stringer 122 comprising flexible strips 126–134, has an upper edge surface 138 which is in supporting contact with the lowermost inner end edge portion of the generalized risers 84. Similarly, the upper edge portion 139 of stringer 124 is in supporting contact with the lowermost outer end edge portion of the generalized risers 84. Alternately, depending upon the interconnection between the cooperating treads and risers, the outer end portions (inner and outer) of the treads could be resting upon the stringers. If risers were not used, the stringers could be in contact with the rear edge of the treads. Thus the stringers 122, 124 are in contact with one end of the risers under each tread. In any event, the stringers provide support for the staircase.

Additionally, the risers preferably have opposite vertical end portions 140*a–e* on the inside end and 142*a–e* at the outside end which are notched. When the risers are oriented in operating position, the notched portions lie in a vertical plane which includes the respective inside or outside curved path defined by the opposite ends of the assembled cooperating treads. The opposite vertical end portions 140*a–e* and 142*a–e* are notched to the same depth as the notches 92*a–e* and 96*a–e* which define the respective inside and outside curved paths or a straight path as indicated in FIG. 9. The generalized riser notches 140, 142 are straight, whereas the generalized notches 92, 96 may be straight to define a straight path and curved to define a curved path.

Once the stringers 122, 124 are laid up and laminated against and along the temporary supports, at least a first flexible strip 136 or a first flexible strip 136 and a second flexible strip 137, by reference to FIG. 9, are specially configured to lay up and laminate along the respective inside and outside paths, having upper edge means adapted to engage on either side of the curved staircase when assembled, at least the notches 92*a–e*, 96*a–e*, of the respective inside and outside end portions of treads 82*a–e*. Flexible strips 136, 137 in FIG. 9 include longitudinal segments 144 in the upper edge means which are adapted to fit the generalized notches 92, 96 which may be straight or curved.

It must be recognized that the length of the longitudinal segments 144 is established in a manner described in connection with FIGS. 3 and 4 so that they will closely match the notches 92*a–e* and 96*a–e* on the respective inner and outer curved paths for a curved run of staircase. The longitudinal segments in operating position are essentially horizontally oriented to be received in the notches at the ends of the treads which define the straight or curved path the treads must follow and are slightly longer when laid out flat than the actual curved path of a curved segment of the staircase.

The upper edge portions of the flexible strips 136, 137 as illustrated in FIG. 9 preferably also have upright segments 146 generally at fight angles to the longitudinal segments 144 for being received in the notched end portion 140*a–e* and 142*a–e* at the opposite ends of the sequentially arranged risers. The longitudinal mid upright segments may be thought of as created by triangular shaped cutouts in the upper edge of flexible strips 136, 137. Preferably both strips 136, 137 are utilized although it is possible to utilize only one flexible strip 136 on a side and in that case the notches in the ends of the cooperating treads and risers would be shallower so that the outside surface of the assembled staircase side would be smoothly flush and even. Alternatively, the opposite outer ends of the risers instead of having notches might be shortened by the thickness of the flexible strips 136 and/or 137 so that the inside surface of the flexible strips abut the engrain of the opposite outer ends of the risers, which in that case would not need to have the notches 140 as indicated.

Figure 10:
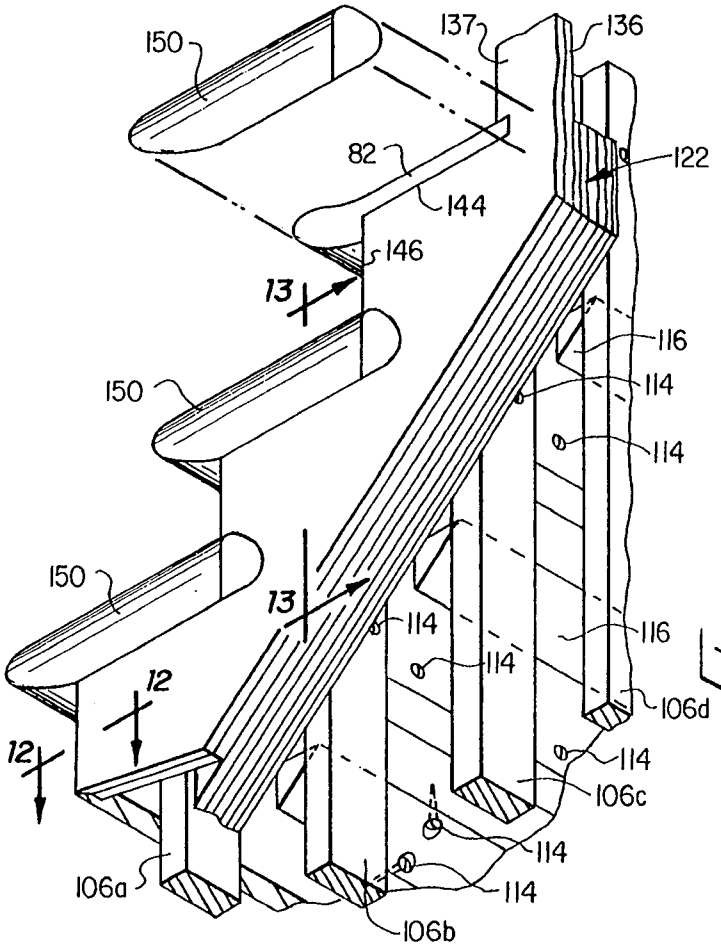
FIG. 10 is a lower side perspective view of the staircase from FIG. 9 in a partially assembled condition.

The completed structure is shown in FIG. 10 when a pair of the flexible strips 136, 137 are laminated to the stringer 122 (or 124) with the longitudinal and upright segments in supporting contact with the notched portions at the opposite ends of the cooperating treads and risers. The outermost surface 148 of the flexible strip 137 preferably lies flush with the extreme generalized outer edge portions 86, 88 of the treads and the joint between the last strip and the outer end of the tread is covered by the end cap returns 150 which cover the seam between the last flexible strip 137 and the treads to prevent any engrain from showing. End cap returns 15 1 as seen in FIG. 16 perform the same function and necessarily have a slightly different shape.

Figure 12:
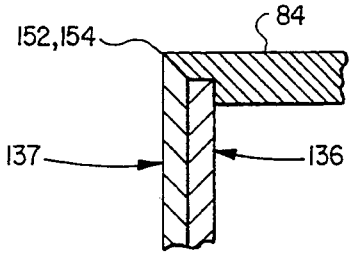
FIG. 12 is a cross-section on the line 12—12 of FIG. 10.

By reference to FIGS. 11–13, a preferred way of interconnecting the present risers with the upper edge means of the specially shaped first and second flexible strips is shown. The riser 84 has a generalized vertical notch 140 and the tread 82 has a generalized notch 92 which come together. Each of the risers 84 has a mitered edge 152 which lies along the outside edge. The first flexible strip 136 has longitudinal segments 144 and upright segments 146 in its upper edge means which are adapted to fit to the cutout area formed by the notches 92 and 140 formed in the edges of the treads and risers. In order to fit properly, longitudinal segments 144 will be longer if they are to fit a curved notched tread than they would be if the notch 92 and the tread is straight as illustrated in FIG. 11. Strip 136 would occupy half the depth of the notched area at the ends of the treads and risers.

The second flexible strip 137 preferably has slightly altered longitudinal segments 144 prime at its upper edge portion which continues into mitered edge portions 154 which are adapted to meet, when in assembly, the mitered edges 152 of the riser portion of the step structure. Second flexible strip 137 may include comer notches 156 which are adapted to closely fit the side outermost edge portion of the treads, in assembly, so that the mitered edge 146 can be placed flush against the mitered edge 152 of the risers. They come together to form a finished look as in FIG. 12 so that no end grain is permitted to show.

FIG. 13 shows a cross-sectional end view of how the flexible strips come together and their relationship in assembly with one of the laminated stringers 122 or 124. It is easily seen how this forms an additional support for the treads and risers because of the interlocking of the notched portions of the treads and risers with the upper edge means of the next to last and last laid first and second flexible strips 136, 137. If the depth of the notched portions of the treads and risers were reduced to one thickness of the special first flexible strip, a flush edge would be provided which could be covered by the end cap 150. It is preferable, however, to have the additional strength and support of the dual layer of first and second flexible strips 136, 137 which are laminated together. The dual layer is also significant because it reduces the sounding board effect of a single layer which sounds hollow and amplifies vibration to create the impression of a cheapness and poor quality construction. The dual layer avoids the necessity of having to add sounding material in the hollow space above the stringer 122 or 124. In addition, the final last layer 137 at the extreme outside edges of the staircase can be formed from solid wood which is prefinished or which will finish up to produce a uniform appearing sidewall without the necessity of adding veneer, an important advantage.

The backing provided by the underlying built-up stringers 122, 124 makes it possible to create butt joints between the ends of adjacent portions of first and second flexible stringers strips 136, 137 which are truly and uniformly curved along the curved path without deviation and without noticeable changes of direction such as would occur at the abutting ends of long thin flexible stringers not solidly backed under the end portions where the joint occurs. In this respect, it should be noted that the underlying first strip 136 provides a complete support to make the butt joints on the last layer 137, which is the only joint which can show.

The stairway is made by assembling the cooperating treads and risers and supporting them into the operating position with the temporary supports 106, 108 as the staircase is created. The lower ends of the temporary supports rest on the floor and may be temporarily fixed to the floor. Cross bracing is preferably used between individual ones of the pairs of temporary supports, such as temporary supports pair 106*c*, 108*c*. In the case of the temporary supports 108*a–e* along the outside curved path, additional temporary supports may be interposed in order to ensure that a continuous smooth curved path is created which will provide the suitable backing for the creation of the stringers. These may be temporarily fixed between temporary supports such as 108*c* and 108*d* and fixed by suitable means to help define the outside curved path.

In the best mode the first layer 126 of the stringer 122, for example, is laid up and fixed in position against the temporary supports as in FIG. 15, by means of a pin gun or pin nailer using short wire which secures it in position. The wires have little or no head. The second layer 128 and subsequent layers may be laid up and secured in place with a combination of adhesive and staples shot from a staple gun because they will be hidden in the completed structure. The combination of staples and adhesive can be used to fix the specially shaped first flexible stringer 136 and the last flexible stringer can be temporarily secured with a pin gun and laminated in place. After the assembly is complete, the temporary supports 106*a–e* and 108*a–e* and any cross bracing or additional supports are removed so that the area under the completed stairway is opened. After the temporary supports are removed from the inside of the stringers, the small pins used to secure the first layer 126 are removed. The pins can be pulled through the surface or cut off so that the inside and outside surface of the finished stringer can be finished.

It was pointed out that the method of the invention is ideally suited to shipping the precut parts to a job site in a kit. The support members (2×4's) are usually available at the job site or may be obtained locally and cut to length.

As a practical matter the kit construction at the job site using the second inventive method in particular, would most likely be started at the top of the spiral staircase and be assembled downwardly from an already established landing. This simply means that the longest support members would be used first to support cooperating treads and risers from the top end and shorter and shorter support members used to work downward. This has the advantage of ensuring the location of the top end of the curved staircase in the event mistakes are made since the location of the bottom of the staircase on the floor is usually less critical. Some deviation from ideal at the bottom is more easily accommodated this way, but it is emphasized that the method contemplates starting first at either the top or bottom and is applicable either way.

Various methods of providing still greater strength and rigidity as well as providing support for sheetrock or other covering for the underside of the completed stairway are contemplated. For example, in FIG. 9, the supports 106, 108 can be cut off even with the bottom surface of the completed stringers 122, 124 or recessed from the bottom surface of the stringers to receive the edges of sheetrock or other covering material which will hide the construction when viewed from underneath. Transverse members can be fixed to the innermost edges of the cut off supports across the width in a position to be used as additional truss like support and a place to secure the sheetrock or other covering sheets that may be employed. These covering sheets would be cut in a generally trapezoidal shape to accommodate the curvature of a curved staircase.

Plates which can be left in place may also be fixed flat against the rear surface of the individual risers with a vertical edge aligned with the edge of each support. The supports would be fastened against the plate and in this case the stringers would be laid up against a combined edge of a plate and a support member alone. The plates would preferably be recessed along the bottom of the finished stringers. After the support members are removed, the plates would remain to add support and could also be used with or without the cut off support members to use as a base for attaching transverse (horizontal) support members to add additional rigidity and provide a base for securing sheetrock or other covering material so the underside of the treads and risers is hidden.

Finally, it is contemplated that the risers as visualized from FIG. 9 could be extended downwardly in the middle section and be notched at each of the end portions to conform to the shape of the bottom edge shown in the horizontal direction and the outermost vertical edge of the support members 106, 108 in the vertical direction with the middle section extending to about the level of bottom edge of the finished stringers on each side. The innermost layer or layers of the stringers could be fastened into the vertical edge of the extended risers for greater support. Normally, the extended and notched stringers would be notched to a greater depth than the vertical outside edge of the support members to accommodate variations in the thickness of the stringer caused by thickness variations in the available stringer strips 126 to 132. The exact position of the outside edge of the support members to set the inside curved path is easily adjusted to accommodate variations in the thickness of the individual stringer strips that may be obtained in the field, so that the completed built-up stringers will be flush with the notched outer edge portions of the cooperating treads and risers.

It is a significant advantage of the process and the structure produced to be able to make quality butt joints between lengths of stringer strip components which are solidly backed by the supports, for this makes a boxable prefabricated kit practical which can be shipped at a greatly reduced cost and assembled without fabrication at the job site. It is very difficult and expensive to obtain and ship the long lengths of flexible stringer strips commonly required to assemble curved staircases. Strips of thirty feet or more are either not available domestically or require special costly fabrication techniques to obtain the required degree of flexibility and are costly and unwieldy to ship and handle. The use of the cooperating treads and risers themselves as a form for laying up the stringer strips and the ability to make the initial butt joints between the ends of the strips against the temporary supports creates a smoothly flowing curved stringer path which is the hallmark of quality construction. Subsequent strips laid up over the initial strip follow the curve and hold the first strip in a solid unified whole after the temporary supports are removed. The outermost flexible strip or dual strips are similarly supported by the underlying stringer which makes smoothly curving butt joints possible there as well. The close fitting interconnection of the outermost strip or strips with the edges of the cooperating treads and risers provides great strength and rigidity to the structure as well as a superior finished appearance. Although the creation of a pattern and the shaping of the parts is conveniently and more rapidly accomplished with the aid of computers and computer controlled cutting tools, the method and structure disclosed does not require the use of computers and can be accomplished with conventional tools, jigs and fixtures.

What is claimed is:

1. A boxable at least partially curved staircase which employs cooperating treads and risers as a form for defining an at least partially curved path to be followed by inside and outside stringers laid up from flexible stringer strips along said curved paths to form at least a curved run of staircase of selected length, the boxable staircase comprising:

cooperating treads and risers in a plurality sufficient to form in sequential combination at least a curved run of staircase, the treads having opposite end portions, having an end portion for the inside formed to define an inside curved path and an opposite end portion for the outside formed to define an outside curved path along the outside end portions of assembled stringers;

said formed opposite end portions of said cooperating treads comprising notches formed along the underside of said treads to lie along the respective inside and outside curved paths;

said plurality of cooperating treads and risers being matable in assembled sequence with a vertically oriented riser under each tread, said risers having a length such that when assembled in sequence with the cooperating treads, opposite vertical end portions of each of the plurality of risers lie respectively in a curved plane which includes the inside and outside curved paths defined by the opposite ends of the assembled cooperating treads;

a multiplicity of flexible strips for laying up together in the form of a curved inside stringer of multiple layers, said strips being of common width and conveniently shippable length;

a multiplicity of flexible strips for laying up together in the form of a curved outside stringer of multiple layers, said strips being of common width and a conveniently shippable length which is less than the full length of the curved stringer required to extend from one end of the curved run to the other end of the curved run;

at least one first flexible strip for laying up along the outside curved surface of an inside curved stringer, said outside curved surface lying along said inside curved path, being in contact with one end of the risers under each tread, when assembled, and having sequential cutaway upper edge means for engaging the inside curved path formed on the inside end portion of sequentially assembled treads;

at least one second flexible strip for laying up along the outside curved surface of an outside curved stringer, when formed, to have its outside curved surface laying along said outside curved path, being in contact with one end of the risers under each tread, when assembled, and having sequential cutaway upper edge means for engaging said outside curved path formed on the outside end portion of sequentially assembled treads; and wherein said upper edge means of said at least one first and second flexible strips are adapted to supportingly follow and engage the notches formed along the underside of sequential treads when assembled to form said staircase.

2. The boxable at least partially curved staircase of claim 1 wherein the opposite end portions of said risers have corresponding notches to those in the opposite end portions of said treads, the riser notches, in mating assembly with the cooperating treads, being located vertically in the plane of the respective inside and outside curved paths and said upper edge means of said at least one first and second flexible strips are adapted to engage, on either side of the curved staircase when assembled, the riser notches to form smooth curved sides along other side of said staircase.

3. The boxable staircase of claim 1 further including a plurality of precut pairs of temporary supporting members for use in assembling the cooperating treads and risers into a curved stairway, said members being sized to fit, in assembly, behind the risers under the treads, to position sequential cooperating treads and risers in operating position along said curved run of staircase.

4. The boxable staircase of claim 1 wherein said parts of temporary supporting members are marked to signify which of the cooperating treads and risers they support during assembly.

5. The boxable staircase of claim 1 wherein said pairs of temporary supporting members intended to support an adjacent cooperating tread and riser differ in length by one unit rise.

6. The boxable staircase of claim 1 wherein said risers include means for locating one of each pair of temporary supporting members laterally positioned inward from said inside and outside curved paths at a position so that one side of each support member, when so positioned, defines the location of the innermost side edge of respective inside and outside stingers which when completed will have an opposite side edge lying along one of said curved paths.

7. The boxable staircase of claim 6 wherein said pairs of temporary supporting members intended to support an adjacent cooperating tread and riser differ in length by one unit rise.

* * * * *